United States Patent [19]

Lyons

[11] 4,246,659

[45] Jan. 27, 1981

[54] POP-UP HAT AND BLANK FOR FORMING SAME

[75] Inventor: Russell J. Lyons, Franklin Park, Ill.

[73] Assignee: Champion International Corporation, Stamford, Conn.

[21] Appl. No.: 45,824

[22] Filed: Jun. 5, 1979

[51] Int. Cl.[3] ..... A42B 1/20; A42B 1/22

[52] U.S. Cl. ..... 2/175; 2/197; 2/200; 2/209.3

[58] Field of Search ..... 2/12, 197, 200, 209.3, 2/175, 195, 196, 209.1, 171.1, 171, 177, 192

[56] References Cited

U.S. PATENT DOCUMENTS

| | | | |
|---|---|---|---|
| 2,292,221 | 8/1942 | Gluck | 2/209.3 |
| 2,679,047 | 5/1954 | Bozzi | 2/12 |
| 2,988,743 | 6/1961 | Wagenfeld | 2/197 X |

FOREIGN PATENT DOCUMENTS

| | | | |
|---|---|---|---|
| 527675 | 7/1956 | Canada | 2/200 |
| 725339 | 1/1966 | Canada | 2/200 |

*Primary Examiner*—Peter P. Nerbun

*Attorney, Agent, or Firm*—Evelyn M. Sommer

[57] ABSTRACT

A planar, unitary blank forms a hat which may fit heads of different sizes and which is adaptable to a wide variety of styles. The blank comprises a brim portion within which display and punch-out portions are formed. The front edge of the display portion is hinged to the brim portion, while its remaining edges are substantially severed. The punch-out portion located adjacent the display portion rear edge may be variously formed to form a plurality of differently sized apertures in combination with the opening created by pivoting the display portion to a position at an angle relative to the brim portion.

4 Claims, 4 Drawing Figures

POP-UP HAT AND BLANK FOR FORMING SAME

BACKGROUND OF THE INVENTION

The present invention relates to a hat formed from a planar, unitary blank formed of paperboard and the blank for forming the hat. More particularly, the present invention relates to a hat and the blank for forming the hat which may be selectively formed with differently sized apertures for receiving heads of different sizes.

Known and conventional pop-up hats and blanks for forming pop-up hats do not have effective means for varying the head opening so that a single blank may be employed to form hats of different sizes. Moreover, such pop-up hats and blanks may not be easily and efficiently used, shipped and stored. Some conventional pop-up hats are particularly disadvantageous in that they require gluing or other fastening operations in order to be formed.

SUMMARY OF THE INVENTION

Accordingly, it is an object of the present invention to provide a hat and a planar, unitary blank for forming the hat which may fit heads of different sizes. In particular, it is the object of the present invention to provide a hat and a planar, unitary blank for forming the hat which may be formed with a plurality of different sized apertures in order that the hat may fit heads of different sizes.

Another object of the present invention is to provide a hat which may be formed from a planar, unitary blank which facilitates shipping and storing.

A further object of the present invention is to provide a blank for forming a pop-up hat and a hat which is strong, simple to assemble, inexpensive and easy to manufacture, and adaptable to a wide variety of styles.

The foregoing objects are attained by providing a planar, unitary blank formed of paperboard for forming a hat comprising a brim portion, a display portion located within the brim portion having front, rear and side edges with the front edge being hingedly attached to the brim portion along a fold line and with the rear and side edges of the display portion being substantially severed, and means for selectively forming a plurality of differently sized apertures comprising in combination a punch-out portion located within the brim portion and adjacent the rear edge of the display portion and an opening created by pivoting the display portion to a position in which it is oriented at an angle relative to the brim portion, whereby a hat may be formed from a blank to fit heads of different sizes.

The foregoing objects are also obtained by a hat formed from a planar, unitary blank of paperboard comprising a brim portion having a periphery, a display portion located within the periphery of the brim portion and positioned at an angle relative to the brim portion with its front edge attached to the brim portion and with its side and rear edges separated frm the brim portion, and means for selectively forming a plurality of differently sized apertures in combination with an opening created by pivoting the display portion to its angular position relative to the brim portion for fitting heads of different sizes.

By forming the blank of the present invention in this manner a planar, unitary blank may be provided which may be easily formed into a hat and may be selectively formed with a variable sized head receiving aperture and which is also simple and inexpensive to manufacture, ship and store, does not require gluing for production, and is adaptable to a wide variety of styles. Thus, the problems experienced heretofore in the production of pop-up hats are eliminated.

Other objects, advantages, and salient features of the present invention will become apparent from the following detailed description, which, when taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE PREFERRED EMBODIMENTS OF THE INVENTION

Figure 1:
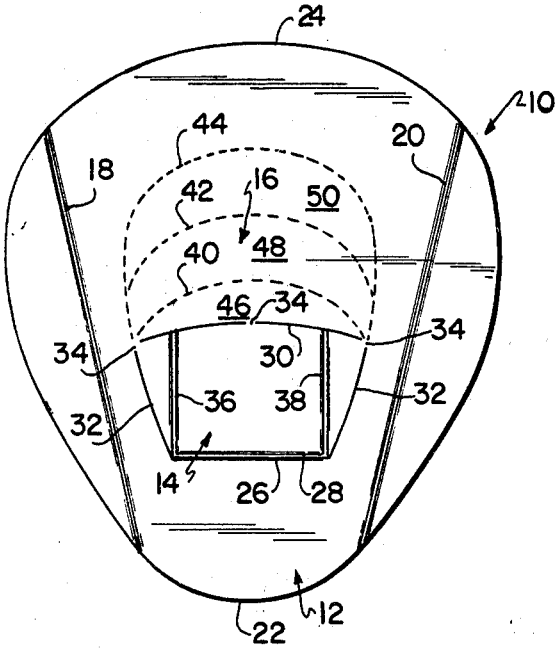
FIG. 1 is a plan view illustrating a blank for forming a hat in accordance with one embodiment of the present invention.
Figure 2:
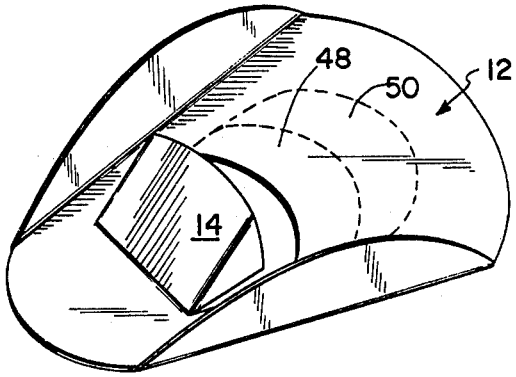
FIG. 2 is a perspective view illustrating the hat formed from the blank of FIG. 1.

Referring to FIGS. 1 and 2, a first embodiment of the present invention is illustrated. This blank 10 comprises a brim portion 12, a display portion 14 and a punch-out portion 16. In this embodiment, as well as the embodiment illustrated in FIGS. 3 and 4, the hat is formed in the style of a cowboy hat. The cowboy hat style is presented solely by way of example to facilitate explanation of the present invention. Any other style of hat may be formed by varying the shape of the various portions as desired.

The blank 10 is unitary and planar. It may be formed of such materials as paperboard.

The brim portion 12 extends about the entire periphery of the blank 10. As stated above, the brim portion 12 may be formed in any configuration, e.g., the ovate configuration illustrated in FIG. 1. First and second fold lines 18, 20 may be formed in the brim portion. The fold lines 18, 20 are oriented at an acute angle relative to each other and extend generally between the front end 22 and the rear end 24 of the blank 10.

The display portion 14 is configured generally in the form of a truncated sector. The brim portion 12 completely surrounds the display portion 14. The front edge 26 of the display portion 14 is hingedly coupled to the brim portion 12 along a fold line 28. The rear edge 30 and the side edges 32 are substantially severed with only small tab portions 34 being left intact at the middle and adjacent the ends of the rear edge 30. The tab portions 34 maintain the display portion 14 in a co-planar relationship with the remaining portions of the blank 10 to facilitate storing and shipping of the blank 10, while permitting easy separation thereof to enable the display portion 14 to be pivoted relative to the brim portion 12 about the fold line 28.

Additionally, the display portion 14 may be provided with third and fourth fold lines 36, 38, respectively. The fold lines 36, 38 extend substantially perpendicularly from each end of the fold line 28. The fold lines 36, 38 enhance the appearance of the display portion 14.

The punch-out portion 16 has three curvilinear lines 40, 42, 44 of perforations. Each of the lines 40, 42, 44 are spaced at a different distance from the front edge 26 of the display portion. A first crescent-shaped section 46 is defined between the display portion rear edge 30 and the first line of perforations 40. A second crescent-shaped section 48 is defined by the first and second lines 40, 42. A third crescent-shaped section 50 is defined between the second and third lines 42, 44. Each of these sections 46, 48, 50 are separately removable by severing the blank 10 along various ones of the display portion rear edge 30, the first line 40, the second line 42 and the third line 44.

To form a hat from the blank 10, the blank 10 is folded to the configuration illustrated in FIG. 2. Initially, the tabs 34 are severed and the display portion 14 pivoted about the fold line 28 to a position in which the display portion 14 is oriented at an angle relative to the brim portion 12. The pivoting of the display portion 14 provides an opening in the brim portion 12, which openings forms a head receiving aperture for the hat with the openings provided by removal of the sections 46, 48, 50. For a small size opening, only section 46 is removed. For a medium size opening, sections 46 and 48 are removed. For a large size opening, all of the sections 46, 48, 50 are removed. In this manner a single blank may be used to form selectively hats of different sizes.

After the display portion 14 has been pivoted and the appropriate sections 46, 48, 50 have been removed to form the desired size opening, folds may be made along fold lines 18, 20 and fold lines 36, 38 to provide the final folded configuration of the hat.

Figure 3:
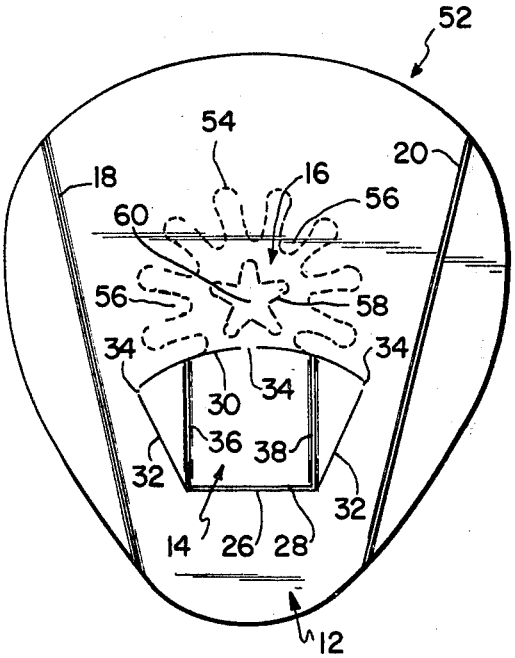
FIG. 3 is a plan view illustrating a blank for forming a hat according to a second embodiment of the present invention.
Figure 4:
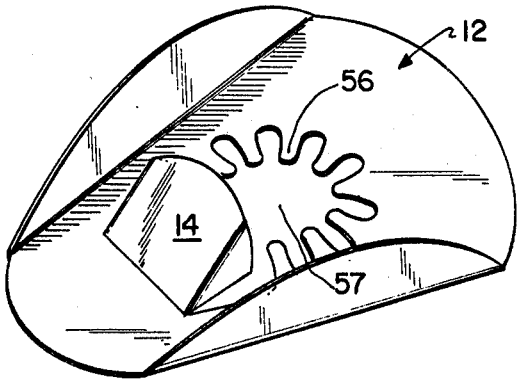
FIG. 4 is a perspective view illustrating the hat formed from the blank of FIG. 3.

Referring now to FIGS. 3 and 4, a second embodiment of the present invention is disclosed. The features of the blank 52 of FIGS. 3 and 4 which are similar to those of the blank 10 of FIGS. 1 and 2 are denoted with the same reference numeral. Accordingly, there is no need to further discuss these features in detail. As is shown in FIGS. 3 and 4, the brim portion 12 and the display portion 14 of FIGS. 3 and 4 are substantially identical to the corresponding portions of the embodiment illustrated in FIGS. 1 and 2. The difference between the embodiments lies in the configuration of the punch-out portion 16.

In the embodiment of FIGS. 3 and 4, the punch-out portion 16 comprises an undulating curvilinear line 54 of perforations which facilitate removal of the punch-out portion 16. The line 54 defines a plurality of radially inwardly extending finger-like sections 56 which extend radially inwardly towards a point generally in the center of the punch-out portion 16. When the punch-out portion 16 is separated from the remainder of the blank 52 and the display portion 14 is pivoted to a position in which it is oriented at an angle relative to the brim portion 12, a head receiving aperture 57 is defined in the blank 52 by the openings provided by the pivoting of the display portion 14 and the removal of the punch-out portion 16. The size of this aperture may be adjusted by deforming the finger-like sections 56.

A further line 58 of perforations in the form of a closed figure is provided within the undulating curvilinear line 54 and the display portion rear edge 30. The line 54 defines a punch-out item 60 which may also be worn by the wearer of the hat. The item 60 may relate to the style of the hat itself. For example, in the cowboy hat style illustrated in FIGS. 3 and 4, the configuration of the punch-out item 60 is that of a sheriff's star.

While particularly advantageous embodiments have been chosen to illustrate the invention, it will be understood by those skilled in this art that various changes and modifications can be made therein without departing from the scope of the invention as defined in the appended claims.

What is claimed is:

1. A unitary, planar blank formed of paperboard for forming a hat comprising:

a brim portion;

a display portion located within said brim portion having front, rear and side edges, said front edge being hingedly attached to said brim portion along a fold line, said rear and side edges of said display portion being substantially severed; and means for selectively forming a plurality of differently sized apertures comprising, in combination, a punch-out portion located within said brim portion and adjacent said rear edge, said punch-out portion being defined by an undulating curvilinear line of perforations, said line defining a plurality of radially inwardly extending finger-like sections which radiate towards a point generally in the center of said punch-out portion, said finger-like sections capable of being variously deformed to form differently sized apertures after removal of said punch-out portion, and an opening created by pivoting said display portion to a position in which it is oriented at an angle relative to said brim portion;

whereby a hat may be formed from the blank to fit heads of different sizes.

2. A blank according to claim 1, wherein additional fold lines are provided in said display portion which extend substantially perpendicularly from each end of the fold line between said brim and display portions.

3. A blank according to claim 1, wherein said punch-out portion includes a line of perforations in the form of a closed figure located within said undulating curvilinear line and said rear edge of said display portions.

4. A hat formed from a planar, unitary blank of paperboard comprising:

a brim portion having a continuous periphery;

a display portion located within said periphery of said brim portion and positioned at an angle relative to said brim portion, said display portion having front, rear and side edges, said front edge being attached to said brim portion, said side and rear edges being separated from said brim portion; and means for selectively forming a plurality of differently sized apertures, disposed entirely within the periphery of said brim portion, in combination with an opening created by pivoting said display portion to its angular position relative to said brim portion for fitting heads of different sizes, said means including a die cut portion defined by an undulating curvilinear line located within said brim portion and rearwardly of said display portion, said line extending from one side edge of said display portion to the other side edge thereof, said line forming a plurality of radially inwardly extending finger-like sections which radiate towards a point generally in the center of said differently sized apertures, whereby said finger-like sections may be variously deformed to form differently sized apertures.

* * * * *